US005828205A

United States Patent [19]

Byrne

[11] Patent Number: 5,828,205

[45] Date of Patent: Oct. 27, 1998

[54] INTEGRATED CIRCUIT WITH AN ONBOARD REGULATOR HAVING AN OPTIONAL EXTERNAL PASS TRANSISTOR

[75] Inventor: T. Gerard Byrne, Dublin, Ireland

[73] Assignee: Skelbrook, Dublin, Ireland

[21] Appl. No.: 810,428

[22] Filed: Mar. 4, 1997

[51] Int. Cl.[6] ..... G05F 1/59

[52] U.S. Cl. ..... 323/268; 323/269; 323/272

[58] Field of Search ..... 323/268, 269, 323/272; 363/147

[56] References Cited

U.S. PATENT DOCUMENTS 5,025,203 6/1991 Edwards ..... 323/268
5,528,127 6/1996 Streit .

*Primary Examiner*—Jeffrey Sterrett
*Attorney, Agent, or Firm*—Richard K. Robinson

[57] ABSTRACT

An integrated circuit has an on-chip voltage regulator circuit. The voltage regulator circuit includes a control circuit, a pass element and a control connection and also provided is a connection for connecting an external pass element to the voltage regulator. There is a switch circuit that when an external pass element is connected to the voltage regulator, the switch circuit will turn off the internal pass element.

9 Claims, 1 Drawing Sheet

INTEGRATED CIRCUIT WITH AN ONBOARD REGULATOR HAVING AN OPTIONAL EXTERNAL PASS TRANSISTOR

BACKGROUND OF THE INVENTION

This invention relates to an integrated circuit having an onboard voltage regulator with an internal pass element; and more particularly, this invention is related to an integrated circuit with an onboard voltage regulator having provisions for connecting an external pass element to the integrated circuit and that when the external pass element is connected to the integrated circuit, the internal pass element is disabled.

It is desirable to provide regulated power to integrated circuits. However, there are situations where there are many advantages to have the regulated portion of the power supply mounted on the integrated circuit's chip. However, with high power consumption and the inability for the chip to dissipate the power generated by the pass element portion of the voltage regulator, it is often desirable to relocate the voltage regulator off chip. This causes an increase in cost due to the duplication of the major circuit portions of the voltage regulator.

An example of a dual pass element voltage regulator is disclosed in U.S. Pat. No. 5,528,127 which disclosed a method and apparatus for providing a regulated output voltage when supplied with an unregulated input voltage that utilizes a detection circuit to selectively steer current between two current paths in order to minimize the amount of power dissipated by a pass device.

SUMMARY OF THE INVENTION

An integrated circuit has an on-chip voltage regulator circuit. The voltage regulator circuit includes a control circuit, an internal pass element and a control connection and also there is provided a connection for connecting an external pass element to the voltage regulator. There is a switch circuit that when the external pass element is connected to the voltage regulator, the switch circuit will turn off the internal pass element.

In one embodiment of the invention the circuit utilizes a P channel pass transistor, a pull-up current source, and a P channel diode voltage drop to switch off the internal pass transistor when the external pass transistor is connected to the voltage regulator.

The control circuit is a closed loop control circuit that compares the regulated output voltage with a reference voltage and provides the appropriate base or gate output signal to the pass element so as to maintain the output voltage close to the reference voltage.

The voltage regulator may be disabled by connecting the control connection to a reference potential such as the voltage supply in the embodiment of utilizing P channel transistors.

It is an object to provide an on chip voltage regulator to regulate the power provided to an integrated circuit.

It is yet another object of the invention to provide an on chip voltage regulator with provisions for connecting an off chip pass element for decreased power dissipation on the integrated circuit chip.

These and other objects and advantages may be realized from a reading of the description of the embodiments in conjunction with the claims and the figures.

DETAILED DESCRIPTION OF THE PREFERRED EMBODIMENT

Figure 1:
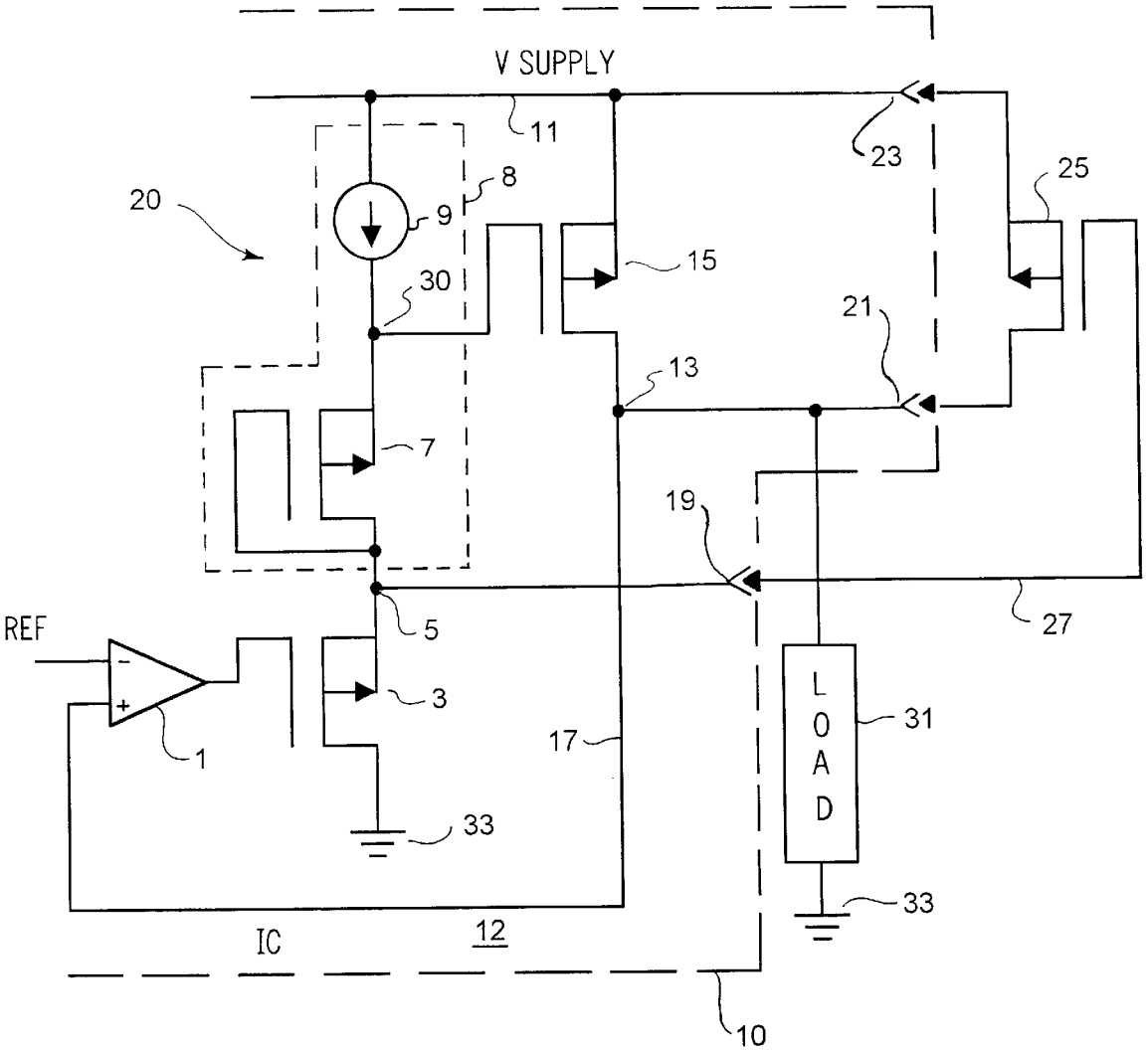
FIG. 1 is a schematic diagram of an integrated circuit containing the voltage regulator according to the invention.

In FIG. 1, to which reference should now be made, there is shown an Integrated Circuit (IC 12) mounted on a chip 10 and the integrated circuit includes a voltage regulator circuit 20 having an internal pass transistor 15. The voltage regulator includes a comparator or operational amplifier 1 that compares the output voltage provided at node 13 with a reference voltage. The output of the comparator 1 is supplied to a P channel transistor 3 that is connected between a node 5 and the substrate 33. The node 5 is a control node that controls the internal pass transistor 15 via a P channel diode 7 and as will be explain later an external pass transistor 25 when connected to the integrated circuit. Connected between the voltage supply and node 5 is a biasing circuit 8 that includes a current source 9, a node 30 and the P channel diode 7. Either one or both the current source 9 and P channel diode 7 may be replaced with a resistor or resistors as is know in the art. The P channel diode 7 is connected between the node 30 and node 5. The pass transistor 15 has a drain connected to the voltage supply and a source connected to node 13.

In normal operation the output of the comparator 1 will cause the voltage at the node 13 to control the conductance of the P channel transistor 15 so as to maintain the voltage at node 13 approximately equal to the reference voltage that is applied to the positive terminal of the comparator 1. A load 31 is connected between the node 13 and a reference potential such as the substrate. The voltage drop across the load 31 is maintained at approximately equal to the voltage reference.

Terminals 23, 19 and 21 represent external connections from the integrated circuit 12 to an external pass transistor 25 and function as switches. The terminals 23, 19 and 21 may be leads, pads or any other means of connecting an integrated circuit to off chip components. The external pass transistor 25 is connected to the voltage supply via terminal or switch 23; it drain is connected via terminal or switch 21 to node 13 and it gate is connected via terminal or switch 19 to node 5. When the above connections are made to the terminals 23, 19 and 21, the biasing circuit 8 functions as a switch and curtails current conduction through the transistor 15. The voltage on the gate of transistor 15 is greater than the voltage on the gate of the external pass transistor 25 causing the external pass transistor 25 to be more conductive and effectively shunting transistor 15 and causing it to turn off. This is due to the voltage drop across the P channel diode 7 and the connection of external pass transistor 25 across transistor 15. The external pass transistor 25 conducts current to the load 31 under the control of the output of the comparator 1.

Figure 2:
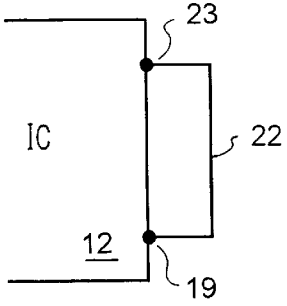
FIG. 2 is a representation of the disabling of the voltage regulator on the integrated circuit according to the invention.

In the embodiment of FIG. 2 in which P channel transistors are utilized, the control terminal 19 is connected to the voltage supply terminal or lead 23. When this occurs the transistor 15 is biased off and the voltage regulator circuit ceases to operate.

I claim:

1. An integrated circuit mounted on a chip has a means for connecting an optional external pass element located off chip to the integrated circuit, the integrated circuit comprises:

a voltage regulator including; a control circuit with a control input and a control output—an internal pass element having first and second connections and a control connection—a disable circuit having first and second nodes and an output node—a voltage bus—and a common bus—the internal pass element having the first connection connected to the voltage bus, the second connection connected to the control input and the control connection connected to the output node—the first node being connected to the voltage bus, the second node being connected to the control output—and a load being connected between the input and the common bus—the voltage bus and the control input and the control output being arranged to be connected to the external pass element, the external pass element having an input lead, control lead and output lead; and whereby in a first mode of operation, when the external pass element is not connected to the voltage bus, the control input and the control output, the internal pass element conducts current from the voltage bus to the load and in a second mode of operation, when the input lead is connected to the voltage bus, the output lead is connected to the control input and the control lead is connected to the control output, the disable circuit disables the internal pass element and the external pass element conducts current from the voltage connection to the load.

2. The integrated circuit according to claim 1 wherein the disable circuit includes:

a diode;

a current source connected between the voltage bus and the diode on a first end and the control output on a second end and whereby the output node is the connection between the current source and the diode.

3. The integrated circuit according to claim 1 wherein the control circuit comprises:

an operational amplifier having a first input connected to a voltage reference and a second input being the control input to the control circuit.

4. An integrated circuit mounted on a chip including a load and, the integrated circuit comprising:

a voltage regulator means for regulating the voltage across the load and including; in a first mode of operation an on chip pass element means for controlling the current that passes through the load, a control means operatively connected to the load and the on chip pass element means for sensing the voltage across the load and for controlling the conductance of the on chip pass element means in response to the sensed voltage and in a second mode, a connecting means, operatively connected to a voltage source, the load and control means, for connecting an off chip pass element means to the integrated circuit and a disabling means for sensing a connection of the off chip pass element means and for disabling the on chip pass element means when the off chip pass element means is connected to the integrated circuit.

5. The integrated circuit according to claim 4 wherein the disabling means includes:

a series connection of a diode and a current source.

6. The integrated circuit according to claim 4 wherein the control means comprises:

a comparator for comparing a reference voltage to the sensed voltage across the load and to provide a control signal based upon the results of the comparison of the reference and sensed voltages, whereby the control signal controls the conductance of the on chip pass element means and when present, the off chip pass element means.

7. The integrated circuit according to claim 4 further comprising:

a regulator disable means for disabling the voltage regulator means.

8. A method for regulating the voltage across a load of an integrated circuit mounted on a chip comprising:

in a first mode of operation controlling the current that passes through the load with an on chip pass element including the steps of; sensing the voltage across the load, controlling the conductance of the on chip pass element in response to the sensed voltage, and in a second mode of operation sensing the connection of an off chip pass element to the integrated circuit and disabling the on chip pass element when the off chip pass element is connected to the integrated circuit.

9. The method according to claim 8 wherein the step of controlling the conductance includes the step of:

sensing the voltage across the load and comparing a reference voltage to the sensed voltage across the load and generating a control signal from the comparison that controls the conductance of either the on chip pass element or the external pass element.

* * * * *